United States Patent [19]

Dibbens

[11] 4,252,008

[45] Feb. 24, 1981

[54] APPARATUS FOR REMOVING DENTS FROM AUTOMOBILE BODIES AND THE LIKE

[76] Inventor: William L. Dibbens, 115 Park St., Ft. Morgan, Colo. 80701

[21] Appl. No.: 12,648

[22] Filed: Feb. 16, 1979

[51] Int. Cl.[3] ..... B21D 26/14

[52] U.S. Cl. ..... 72/56; 72/389; 72/430; 72/705

[58] Field of Search ..... 72/705, 389, 430, 56, 72/453.01; 29/421 M

[56] References Cited

U.S. PATENT DOCUMENTS

| | | | |
|---|---|---|---|
| 2,443,931 | 6/1948 | Stults | 72/705 |
| 2,510,253 | 6/1950 | Reed | 72/705 |
| 2,605,658 | 8/1952 | Sanchez | 72/705 |
| 3,340,720 | 9/1967 | Chartier | 72/705 |
| 3,545,250 | 12/1970 | Jones | 72/705 |
| 3,776,022 | 12/1973 | Lionello | 72/705 |
| 3,998,081 | 12/1976 | Hansen | 29/421 M |
| 4,116,035 | 9/1978 | Malarsky | 72/705 |

FOREIGN PATENT DOCUMENTS

| | | | |
|---|---|---|---|
| 2159515 | 6/1973 | Fed. Rep. of Germany | 72/705 |
| 2030497 | 11/1970 | France | 72/705 |
| 329131 | 9/1970 | Sweden | 72/705 |

*Primary Examiner*—Leon Gilden
*Assistant Examiner*—Gene P. Crosby
*Attorney, Agent, or Firm*—Wm. Griffith Edwards

[57] ABSTRACT

An electromagnetic device for straightening dents in automotive vehicle bodies and the like comprises a carriage on which is mounted a boom means for positioning an electromagnetic head at selected positions about the sides and top of a vehicle body. Control and power apparatus including electric power and a hydraulic fluid supply are mounted on the carriage, and quickly adjustable brace means are provided to engage the vehicle body adjacent a damaged area for bracing the body against the pull of the magnet.

13 Claims, 11 Drawing Figures

APPARATUS FOR REMOVING DENTS FROM AUTOMOBILE BODIES AND THE LIKE

My invention relates to apparatus for removing dents from automobile bodies and the like and particularly to an improved apparatus of the type utilizing a magnet for effecting the straightening of a damaged sheet metal body.

Tools or equipments of various types have been used heretofore for effecting the straightening of the sheet metal bodies of automotive vehicles. These have included devices which require mechanical attachment to the damaged body and also devices employing electromagnets for engaging the straightening such bodies. While these devices have been suitable for some applications, they have not been fully effective for all applications. Accordingly, it is an object of my invention to provide an improved arrangement utilizing magnetic attraction for effecting the removal of dents from motor vehicle bodies and the like.

It is another object of my invention to provide an improved apparatus utilizing magnetic attraction to straighten damaged sheet metal bodies and which may be quickly and effectively applied for use in a wide range of positions on a body.

It is another object of my invention to provide an improved magnetic type of sheet metal body straightener and a carriage therefor for quickly positioning the straightener adjacent the damaged portion of the body.

It is a further object of my invention to provide a sheet metal body straightener of the magnetic type including an improved arrangement of the electric magnetic mechanism and a bracing device therefor.

Briefly, in carrying out the objects of my invention in one embodiment thereof, I provide a wheeled carriage on which an electromagnetic head is supported on an adjustable boom allowing it to be positioned adjacent any area of the sides and top of a vehicle body. An adjustable boom structure carries the magnetic head and hydraulic mechanisms controlled from the carriage are used to position and move the magnetic head, and the hydraulic and electric supply equipment is mounted in the carriage together with the required controls. The magnetic head is mounted on a hydraulically operated rod and adjustable side braces are provided for engagement with the body to be straightened adjacent the portion engaged by the magnet and the magnet while energized and engaging the body is moved hydraulically away from the body which is restrained by the braces. The apparatus facilitates the quick positioning adjacent any part of a vehicle body and the position is readily readjusted as required for effective straightening of the damaged area.

The features of novelty which characterize my invention are pointed out with particularity in the claims annexed to and forming a part of this specification. My invention itself, however, together with further objects and advantages thereof, may best be understood upon reference to the following description taken in connection with the accompanying drawings in which:

Figure 1:
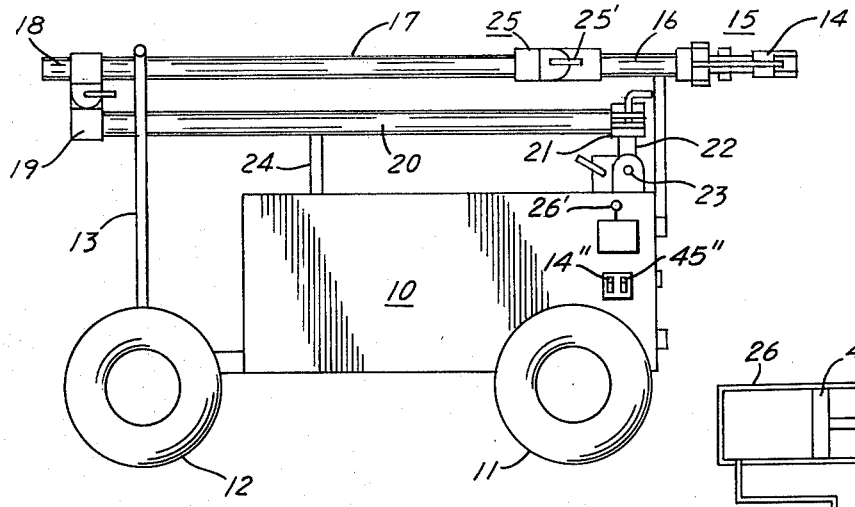
FIG. 1 is a side elevation of an apparatus embodying my invention mounted with the boom mounted on a carriage with the boom in tracking position.
Figure 2A:
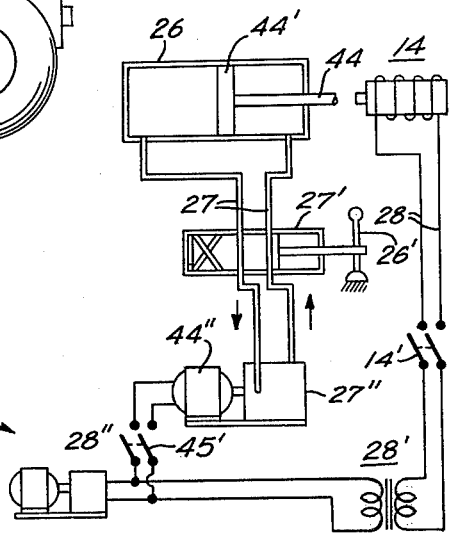
FIG. 2 is a right-hand end view of the apparatus of FIG. 1 with the boom upright.
Figure 3:
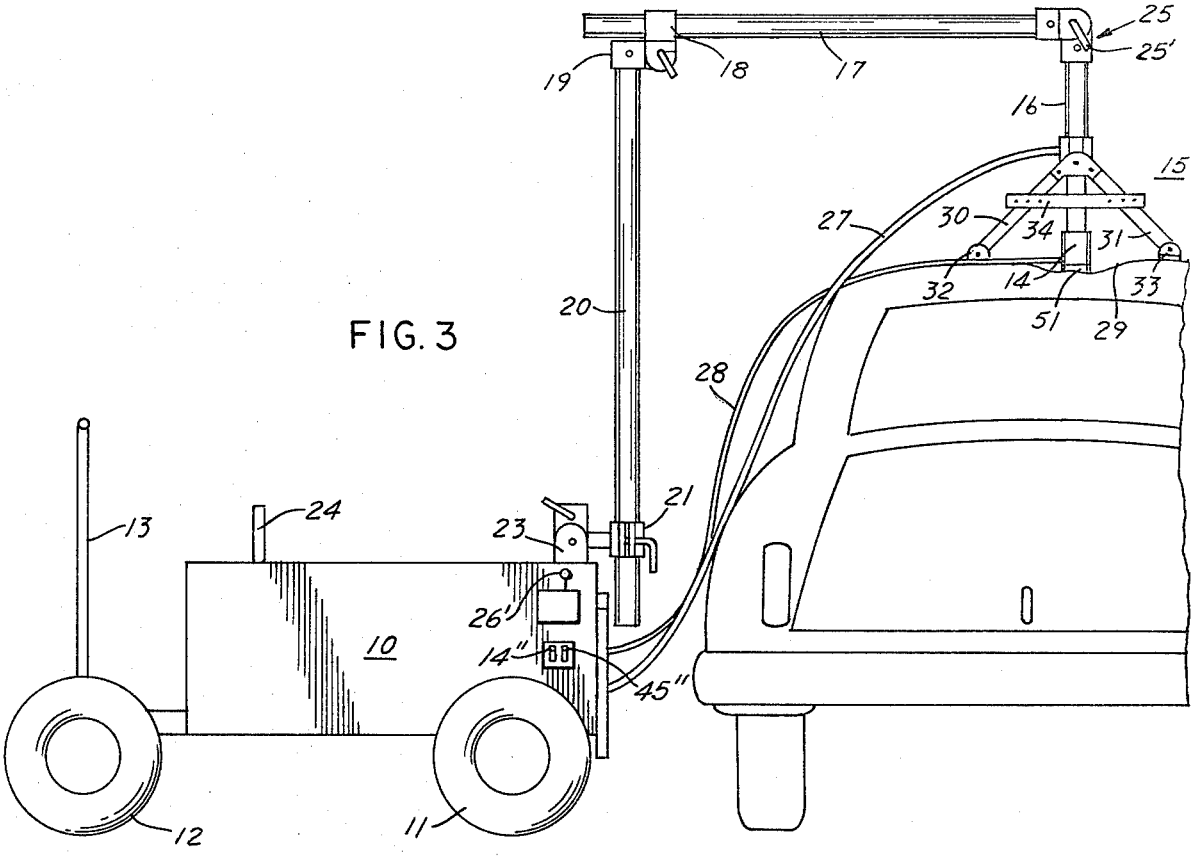
Figure 4:
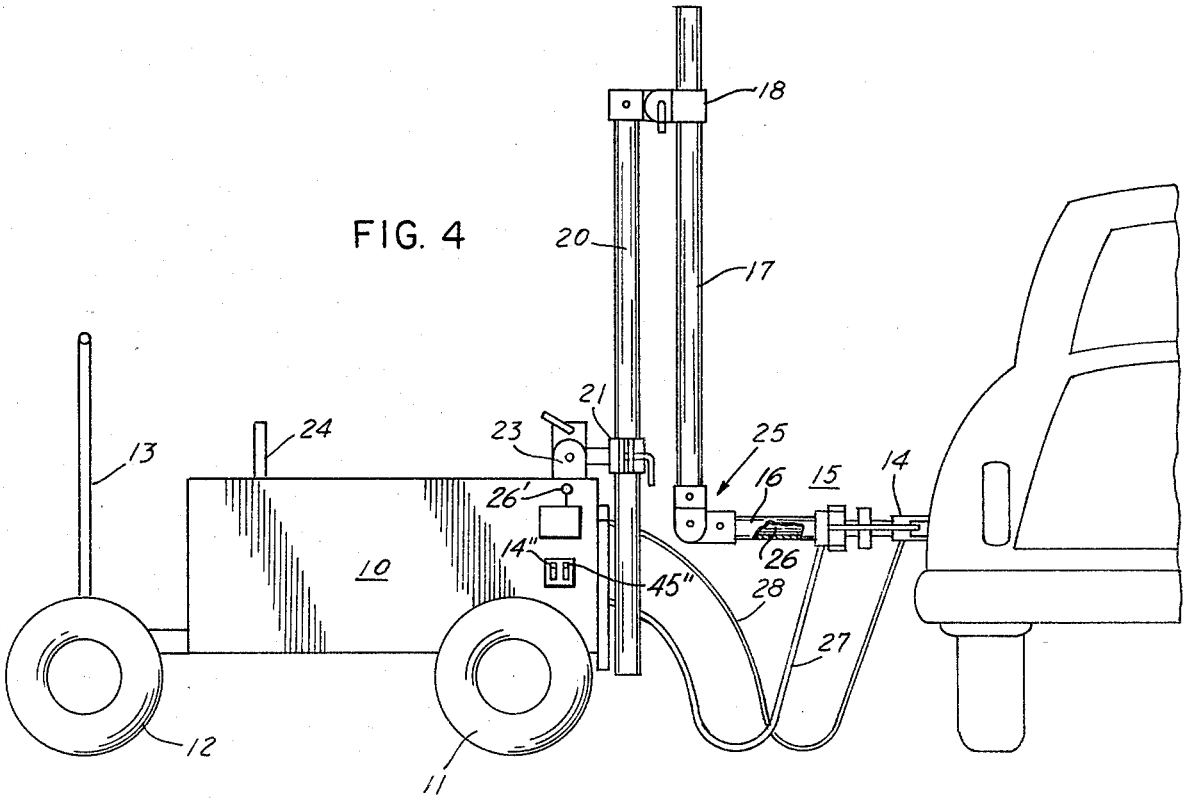
Figure 5:
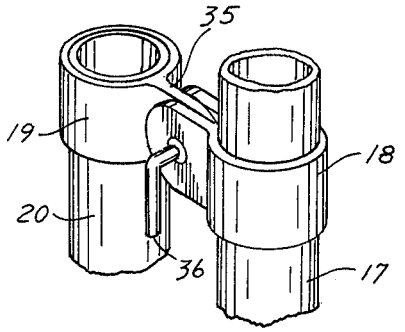
Figure 6:
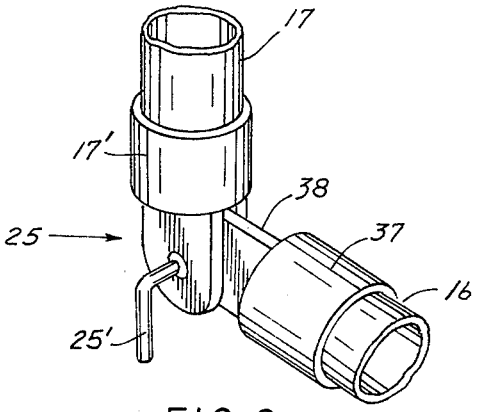
Figure 7:
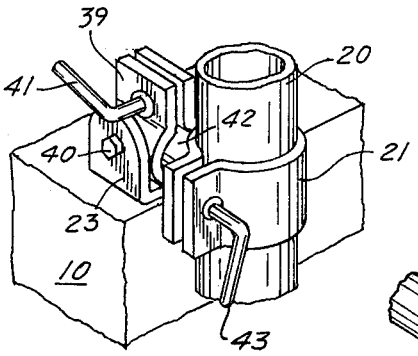
Figure 8:
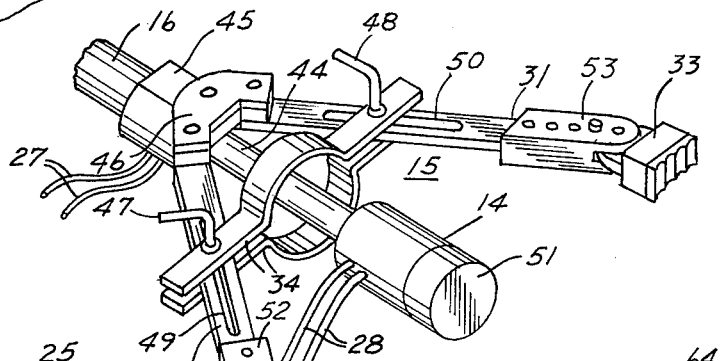
Figure 9:
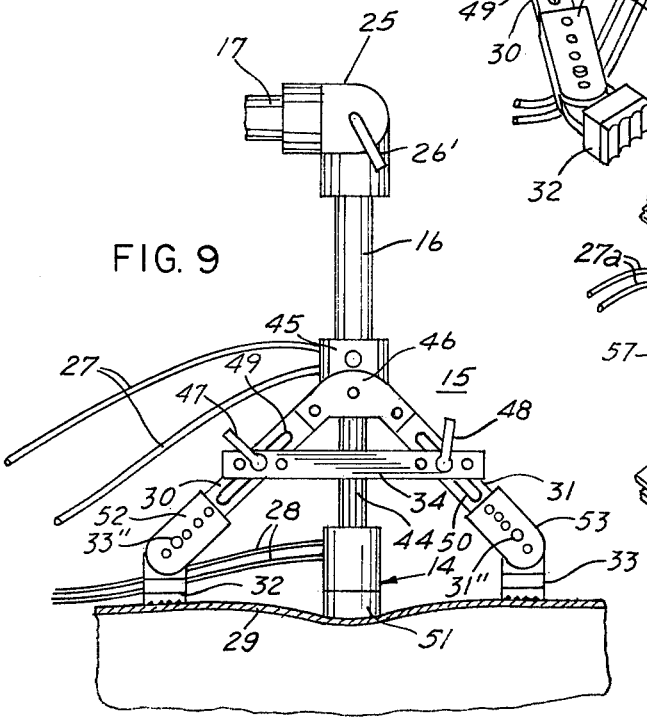

FIG. 2*a* is a diagrammatic illustration of the electrical and hydraulic control system for the apparatus;

FIG. 3 is a side elevation of the apparatus in position adjacent a vehicle with the boom positioned for reaching a dent in the top of the vehicle;

FIG. 4 is a view similar to FIG. 3 with the boom positioned for removal of a depression in the side of the vehicle body;

FIGS. 5, 6 and 7 are enlarged perspective views of the three adjustable joints of the apparatus;

FIG. 8 is an enlarged isometric view of the magnet holding and bracing mechanism;

FIG. 9 is a top plan view of the device of FIG. 1; and

Figure 10:
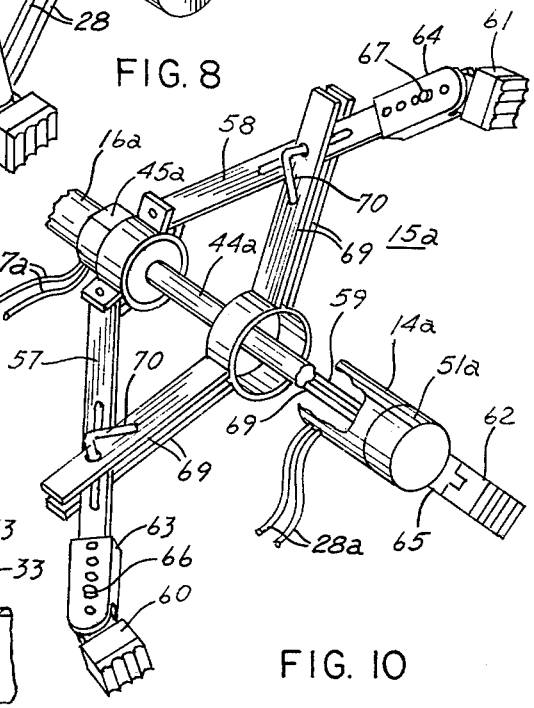

FIG. 10 is an isometric views similar to FIG. 8 illustrating a modification of the magnet holding and bracing structure.

As illustrated in FIG. 1, the apparatus comprises a body or housing 10 mounted on wheels 11 and 12, wheels 12 being the front guiding wheels and having a handle 13 shown in its upright position in FIG. 1. Electromagnet 14 is mounted on a holding and bracing structure 15 attached to a supporting boom member 16 which is hinged on a boom 17 which is slidable in a collar 18 and pivotally attached to a collar 19 on a boom member 20. The three boom members 16, 17 and 20 are assembled to provide the adjustable boom structure for positioning the straightening mechanism. The boom member 20 is slidably mounted in a sleeve 21 secured to a strut 22 which is pivoted at 23 on a rigid support on the body 10. The forward end of the boom 20 is arranged to rest on a support 24 to which it may be attached when the equipment is being moved for substantial distances. The magnetic force attracts and holds a contacted portion of the deformed body wall and force is applied by a hydraulic mechanism working against bracing arms of the structure 15 which engage the body laterally of the dented portion.

Figure 2:
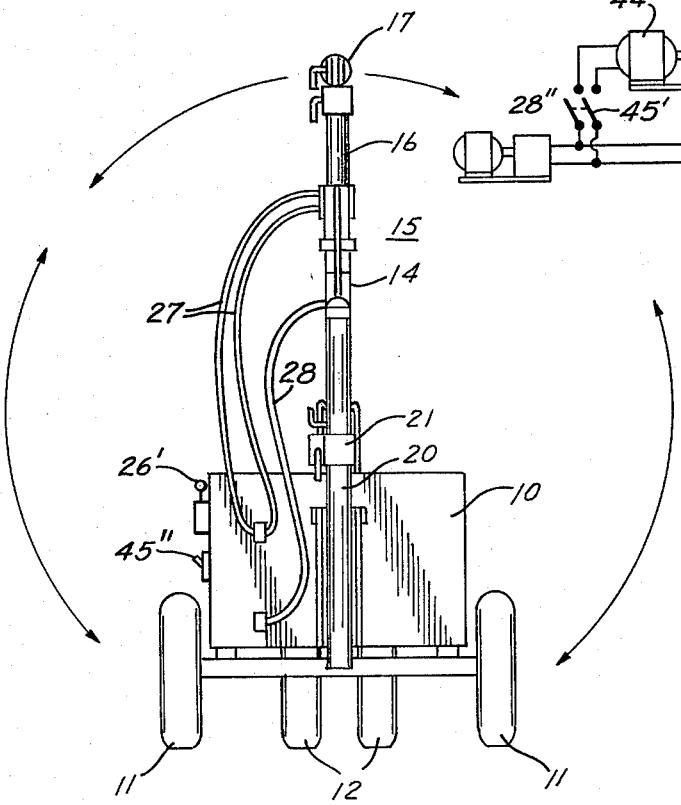

In FIGS. 2 and 3, the boom structure is shown in an erected position so that the magnetic apparatus may be placed in position for removing a dent from the top of an automobile as indicated in FIG. 3. As shown in these figures, the boom member 16 is pivotally mounted on one end of the boom member 17 by a fixture 25, and may be set at any desired angle by loosening the pivoted parts of fixture 25 by operation of a wrench 25'.

For some applications, in order to facilitate the manual positioning of the magnet, it may be desirable to construct the boom members of light metal such as aluminum alloy. Further, the weight of the electromagnet and bracing assembly may be counter-balanced in whole or in part by spring means or counter weights. For other applications it may be desirable to provide hydraulic, or electrical mechanisms for manipulating the boom structure.

Within the body 10 there is provided hydraulic equipment for supplying actuating fluids to a hydraulic cylinder 26, shown in FIG. 4, for driving the piston therein and moving the magnet 14 toward and away from its position of engagement with the car body or other object to be straightened. Hydraulic fluid is supplied through a pair of length of flexible high pressure hose or tubing 27 and electric current for energizing the magnet is supplied through lines 28. A power transformer 28' indicated in FIG. 2*a* for supplying the lines 28 is also mounted within the housing 10 and a suitable motor-generator set 28' also mounted in the housing is provided for producing the required electric power.

As stated above, the hydraulic and electric supply equipment and required controls are mounted in the carrier. Any suitable hydraulic system and electromagnet energizing the control system may be employed. By way of example, FIG. 2*a* illustrates diagrammatically such electric and hydraulic control systems. A motor-generator unit 28″ supplies current to lines 28 through a transformer 28′ and a switch 14′. Power is also supplied to a motor 44″ which drives a hydraulic fluid supply pump 27″ connected to deliver hydraulic fluid through a reversing valve 27′ to the two sides of the piston 44′. The motor 44″ is controlled by operation of a switch 45′ and the flow and direction of the hydraulic fluid is controlled by a reversing valve 27. The two hoses 27 are connected to direct pressure fluid to and from the cylinder 26, each being connected to a respective side of the piston 44′. The flow of fluid is under the control of reversing valve 27′ to move the magnet 14 and to apply the pulling force. As shown in FIGS. 1 through 4, control levers or handles for the valve 27′ and switches 14′ and 45′ are mounted on the outside wall of the housing 10 in convenient positions for use by the operator. The control handle for the reversing valve is indicated at 26′ and the control levers for the switches 14′ and 45′ are indicated at 14″ and 45″, respectively.

As shown in FIG. 3, the magnet 14 has been placed in engagement with a dent 29 in the top of an automobile and side braces 30 and 31 have been spread with their rubber covered feet 32 and 33, respectively, in engagement with the top of the automobile roof on either side of the dent. An adjustable brace 34 engages the side bars 32 and 33 and holds them in their required angular position with the feet in engagement with the top of the automobile roof on either side of the dent. When the magnet has thus been positioned, the hydraulic equipment is actuated to raise the magnet and thereby draw the dented top 29 upwardly against the bracing force of the legs 30 and 31. When the magnet is energized and the hydraulic piston 44′ in the cylinder operatedto draw it upwardly, the metal of the dent 29 is moved upwardly until it is in a position near the normal position of the roof. Additional operations of the magnet may be necessary to draw various portions of the dented roof into their desired positions.

The dent pulling structure including the magnet 14 and the side braces 31 and 32 is thus arranged so that the dent straightening forces are confined to this structure and no force is exerted between the carriage 10 and the vehicle body, and the body does not require bracing against possible displacement.

The magnet structure is provided with interchangeable heads or contact members which may be shaped to various configurations desirable for engagement with the metal of the roof. With careful adjustments of the positions of the magnet on the dent, the roof may be brought into general alignment with its normal position. The final smoothing of the metal of the roof may be accomplished by conventional methods in the usual manner.

FIG. 4 illustrates the equipment in position for straightening a dent in the side of the body of an automobile. In this view, the member 20 in its vertical position has been moved downwardly in the slidable member 21 and locked and the boom the member 17 has been moved into position parallel to the boom member 20 and downwardly in the attaching member 18. In this position the magnetic assembly 15 has been arranged horizontally with the magnet 14 adjacent the dented portion of the side of a car body. The straightening operation is effected in the same manner as in the illustration of FIG. 3, electrical power being supplied through the cables 28 and the hydraulic fluid through high pressure tubing 27.

The sliding and locking fittings for the boom assembly are illustrated in FIGS. 5, 6, and 7. FIG. 5 illustrates the arrangement of sliding fitting 18 and fitting 19 secured rigidly to the top of the boom member 20 and provided with a lug or extension 35 in which the boom member 17 is slidable and may be locked by turning a wrench handle 36. FIG. 6 illustrates the pivotal connection fittings between the boom members 17 and 16, the fitting 25 having a collar 37 secured to the end of the boom member 16 and pivotally mounted on an end fitting 17′ secured to the boom member 17. The fittings 25′ and 37 are pivotally connected by a lug or extension 38 on the fitting 37 and a bifurcated end of the fixture 25, the locking wrench 25′ being employed to secure the members 17 and 16 in their required angular positions.

In FIG. 7, the mounting 23 on top of the housing 10 is illustrated as holding a clamping member 39 pivotally on a bolt or axle 40 and which may be locked in position by a wrench 41 which clamps the member 35 against a stub 42 rigidly secured to the fitting 21 through which the boom member 20 is slidable and may be locked by operation of a wrench 43.

The pivotal and sliding arrangements of the several boom members make it possible to position the magnet assembly for operation in a wide range of angles including the two illustrated in FIGS. 3 and 4.

FIGS. 8 and 9 illustrate the magnet mounting assembly 15. The magnet 14 is mounted on a piston rod 44 which slides in a block 45 and the rod is actuated by the hydraulic piston mechanism in the boom member 16. The arms 30 and 31 are pivotally mounted on a bracket 46 mounted on the block 45 and may be swung to desired positions and locked in place by wrenches 47 and 48 which pass through slots 49 and 50 in the arms 30 and 31, respectively. The crossbar 34 may thus be clamped in any desired position depending upon the angular relationship required for positioning the rubber covered feet 32 and 33 against the body of the car or other structure to be straightened.

For some applications it may be desirable to make the arms 30 and 31 also adjustable in length; in FIGS. 8 and 9 the arms 30 and 31 are shown as including rectangular adjustable sleeves 30′ and 31′ which telescope over the respective arms and on which the feet 32 and 33 are pivotally mounted. A series of holes are provided in the sleeves and pins 30″ and 31″ are provided for locking the sleeves in selected positions on the arms. For other applications mechanical arrangements such as hydraulic extension means or motor driven screw means, for example, might be desirable for effecting the adjustment of the length of one or more arms.

The magnet 14 is provided with a head or contact member 51, the face of which is shaped to conform generally to the dented area to be contacted by the magnet. The head 51 is of soft iron or other similar magnetic material and is arranged to be screwed or otherwise detachably secured to the main body of the magnet 14 and heads of various sizes and configurations are provided for interchangeable use. The magnet 14 is an electromagnet energized by power supplied through the lines 28 as indicated heretofore.

As illustrated in FIGS. 1, 2, 3 and 4, a portable apparatus has been provided which makes it possible to reach dents formed in the body of automobiles in various positions without having to move cumbersome apparatus into postion or to move the vehicle from its normal upright position. The apparatus may be quickly applied to dents in various parts of the body and the preliminary work of straightening the damaged portions may thus be done easily and quickly.

The modification of the holding and bracing structure illustrated in FIG. 10 is essentially like that of FIG. 8 except that it is of tripod configuration. In this figure the corresponding parts have been designated by the same numerals with the letter "a" added. The three arms of the tripod indicated at 57, 58 and 59 have rubber-like feet 60, 61 and 62, respectively. The feet are attached to respective telescoping sleeves 63, 64 and 65 adjustably secured to the legs 57, 58 and 59 by pins; the pins 66 and 67 for the legs 57 or 58 are visible in the figure, the pins for the leg 59 being obscured by the magnet structure. The cross brace for the holding mechanism comprises a central ring 68 and three sets of parallel bar arms 69 secured by lock wrenches 70. The tripod structure may be useful for some applications where added steadiness of the holding mechanism is desirable.

A flexible, portable and conveniently operated mechanism has thus been provided to utilize the advantages of magnetic straightening of thin-walled articles such as automobile bodies when they are damaged.

Although I have disclosed my invention in connection with apparatus of specific configuration, various modifications and other applications will occur to those skilled in the art. Therefore, I do not desire my invention to be limited to the details illustrated and described and I intend, by the appended claims, to cover all modifications which fall within the spirit and scope of my invention.

I claim:

1. A sheet metal body pulling device for pulling out an indented part of a sheet metal body, said body pulling device comprising:

a movable carriage;

a rod-like pulling member and means for mounting said member on the carriage;

hydraulic means secured on said mounting means for selectively moving the pulling member in directions along its axis, said hydraulic means including a hydraulic cylinder, a piston in the cylinder and a piston rod extending from the piston and functioning as and constituting said pulling member;

magnetic means affixed to the end of the pulling member remote from said cylinder for releasable coupling to a body in an area to be pulled; and bracing means mounted on the cylinder of the hydraulic means for abutting against the body around the area to be pulled to provide a counter-force.

2. A body pulling device as claimed in claim 1, wherein the bracing means includes at least a pair of adjustable arms each affixed at one end to the cylinder of the hydraulic means and abuttable at the other end against the body.

3. A body pulling device as claimed in claim 2, wherein each of said arms comprises telescopically adjustable members, each arm being affixed at one end to the hydraulic cylinder and having its other end engagable with the body.

4. A body pulling device as claimed in claim 1, 2 or 3 including means for adjusting said supporting means to hold said hydraulic means with the axis of said pulling member at selected angular positions between horizontal and vertical whereby said device may be operated to remove indentations in body areas including the top and other areas intermediate the top and the sides.

5. An apparatus for pulling out an indented sheet metal portion of a vehicle body or the like comprising:

a movable carriage, a pulling device and a boom structure for mounting said device on said carriage, said device including a head and a rod mounted thereon for axial movement, an electromagnet mounted on the end of said rod remote from said head, and said head including means for driving said rod for moving said electromagnet toward and away from an indented portion of a sheet metal body, means for affording movement of said boom structure to locate said electromagnet in a position adjacent the dented portion, bracing means attached to said device in fixed relationship to said head and extending into position for engagement with the body adjacent a dented portion therein for bracing the body during pulling of the dented portion, and control means on said carriage for energizing said magnet and for actuating said rod driving means for moving said magnet into engagement with the dent and for thereafter withdrawing the rod during energization of said magnet to move the magnet outwardly and straighten the dented portion of the body.

6. An apparatus as set forth in claim 5 wherein said bracing means includes a pair of arms pivotally mounted on said head and having feet for engaging the vehicle body on opposite sides of the indentation, and adjustable means for securing said arms in selected angular positions with respect to one another for setting the distance between the feet engaging the body.

7. An apparatus as set forth in claim 5 wherein said boom means includes means for holding said head with said rod in selected positions between horizontal and vertical for engaging either the side or the top or intermediate portions of the vehicle body.

8. An apparatus as set forth in claim 5, 6 or 7 wherein said driving means is hydraulically actuated.

9. An apparatus as set forth in claim 5, 6 or 7 wherein said magnet is provided with interchangeable contact heads.

10. A motor vehicle body pulling device for pulling out an indented portion of a motor vehicle body, said body pulling device comprising:

a movable carriage;

a body pulling assembly mounted on the carriage;

said assembly including an electromagnet and a mounting structure and power means on said structure for moving said magnet into engagement with and away from the vehicle body and bracing means mounted on and extending from said structure and adjustable to positions abutting the vehicle body around the body area to be pulled to provide a counter force;

said means for mounting said assembly on said carriage comprising a universally adjustable boom structure constructed and arranged to support said assembly in selected positions adjacent the ends, sides and top of the vehicle body; and control means on said carriage for effecting the energization of said magnet and for controlling said power means during the pulling out of the indented portion of the body.

11. A motor vehicle body pulling device as set forth in claim 10 wherein said adjustable boom structure includes a first straight boom member pivotally and slidably connected to said carriage, a second straight boom member having one end pivotally and slidably connected to the end of said first boom remote from said connection to the carriage and a third boom member carrying said assembly and pivotally connected to the other end of said second boom member.

12. A motor vehicle body pulling device as set forth in claim 10 wherein said power means includes a hydraulic cylinder mounted on said mounting structure and a piston in said cylinder connected to said magnet, and hydraulic fluid supply and control means on said carriage for actuating said piston.

13. A motor vehicle body pulling device as set forth in claim 10 or 11 wherein rubber-like feet are provided for engaging the surface of the vehicle body and preventing injury thereof.

* * * * *